US005586601A

United States Patent [19]

Pringle

[11] Patent Number: 5,586,601

[45] Date of Patent: Dec. 24, 1996

[54] MECHANISM FOR ANCHORING WELL TOOL

[75] Inventor: Ronald E. Pringle, Houston, Tex.

[73] Assignee: Camco International Inc., Houston, Tex.

[21] Appl. No.: 431,876

[22] Filed: Apr. 28, 1995

[51] Int. Cl.[6] ..... E21B 33/128; E21B 33/129

[52] U.S. Cl. ..... 166/212; 166/120; 166/217

[58] Field of Search ..... 166/212, 134, 166/120, 217, 187, 122, 387, 382

[56] References Cited

U.S. PATENT DOCUMENTS

| | | | |
|---|---|---|---|
| 2,121,050 | 6/1938 | Ragan et al. | 166/134 X |
| 2,323,085 | 6/1943 | Davis | 166/217 X |
| 2,332,749 | 10/1943 | Page | 166/212 |
| 2,546,377 | 3/1951 | Turechek | 166/134 X |
| 2,546,950 | 3/1951 | Nixon | 166/212 |
| 2,777,522 | 1/1957 | Page | 166/212 |
| 4,311,196 | 1/1982 | Beall et al. | 166/134 |
| 5,101,897 | 4/1992 | Leismer et al. | 166/217 |
| 5,273,109 | 12/1993 | Arizmendi et al. | 166/123 |
| 5,311,938 | 5/1994 | Hendrickson et al. | 166/134 |
| 5,341,874 | 8/1994 | Wilson | 166/196 |
| 5,417,288 | 5/1995 | Melenyzer et al. | 166/212 X |
| 5,433,269 | 7/1995 | Hendrickson | 166/134 |

*Primary Examiner*—Stephen J. Novosad

[57] ABSTRACT

A longitudinally compact mechanism for anchoring a well tool to a casing includes a plurality of first slip members and a plurality of second slip members. The first slip members and the second slip members are carried on the well tool at the approximate same longitudinal position, and the first slip members are alternately circumferentially positioned with the second slip members. Each slip member is expanded by relative movement of an independent piston operatively connected thereto.

14 Claims, 12 Drawing Sheets

MECHANISM FOR ANCHORING WELL TOOL

BACKGROUND OF THE INVENTION

1. Field of the Invention

The present invention relates to mechanisms for anchoring a well tool to a well casing and, more particularly, to such an anchoring mechanism that comprises an array of slips that are collectively set and which are individually engaged with the inside wall of the well casing.

2. Description of Related Art

It is well known that a packer creates, by its existence in a subterranean well, an annular volume between a well casing and a well tubing, and in some embodiments, is attached to the tubing as it is in inserted in the well. When the desired location in the well is reached during insertion, the packer is "set" by activating an anchoring mechanism commonly referred to as a "slip" (or in plurality "slips") to affix the packer to the well casing, and to compress a sealing member outwardly to seal against an inside diametrical wall of the well casing.

In some packers a hydraulically operated piston is integral to the anchoring mechanism, and utilizes hydraulic pressure applied to the tubing to move the slips into connective engagement with the well casing. Slips typically engage an interior surface of the well casing by a series of hardened teeth which lock the packer in position. Once the packer is set, the ability of the packer to resist movement and maintain a seal, despite the loads that may be imposed during normal operation of the well, is critical to successful operation of the packer and the safety of the well. Loads which are commonly incurred in a well may include tubing weight, wellbore pressure acting on the annular seal area, axial forces due to well pressure fluctuations and/or loads imposed by thermal expansion or contraction of the tubing. In deeper than average wells, the ability of the slips to resist movement is critically important. Some conventional packers employ a single concentric hydraulic piston acting in a single direction on a radial array of slips. The pressure used to set the packer acts on the area of the piston and is translated to an axial force, which in turn acts on an annular cone. The cone contacts a mating conical surface on the slips thereby causing the slips to move radially outward to engage the interior surface of the casing.

It is well known that additional pressure applied to set the packer causes a higher radial force at the slips, which results in a greater ability for the packer to resist the loads in the well. However, the amount of pressure that can be applied to set the packer is often limited by the pressure rating of the tubing. In other words, if a higher pressure is used to set the slips, the slips will deform the tubing. Further, additional axial force can be generated by increasing the piston area, but generally this cannot be done because the available annular area is constrained by the packer outside diameter and the tubing inside diameter.

When a single piston acts on a radial array of slips, lack of concentricity and misalignment can negatively effect packer performance. When one slip contacts the interior surface of the casing, the entire force of the hydraulic piston is transferred to that slip thereby limiting the effectiveness of the remaining slips in the array. This causes the packer to move when the loads are borne by the packer, which can cause the seal to be damaged or destroyed. This condition is only minimally improved by the use of a plurality of pistons since typically one piston acts in the upward direction on a single array of slips and one piston acts in the downward direction on a single array of slips.

There is a need for a device to intensify the setting pressure of the packer by bringing greater force to the slips without increasing setting pressure, and for each slip to be collectively set, but independently moved into connective engagement with the interior surface of the casing.

SUMMARY OF THE INVENTION

The present invention has been contemplated to overcome the foregoing deficiencies and meet the above described needs. Specifically, the present invention is a longitudinally compact mechanism for anchoring a well tool, such as a packer, to a casing. The mechanism of the present invention includes a plurality of first slip members, adapted to restrain well tool movement in a first direction, and a plurality of second slip members, adapted to restrain well tool movement in a second direction. The first slip members and the second slip members are carried on the well tool at the approximate same longitudinal position, with the first slip members alternately circumferentially positioned with the second slip members. The resulting mechanism is significantly shorter in length than comparable mechanisms.

Each of the slip members is moved by the relative movement of an independent piston, so that the slip members are individually moved into engagement with the interior surface of the casing. This feature allows the well tool to have slip members moved by greater collective setting area than previous anchoring mechanisms.

DETAILED DESCRIPTION OF THE PREFERRED EMBODIMENTS

Figure 1A:
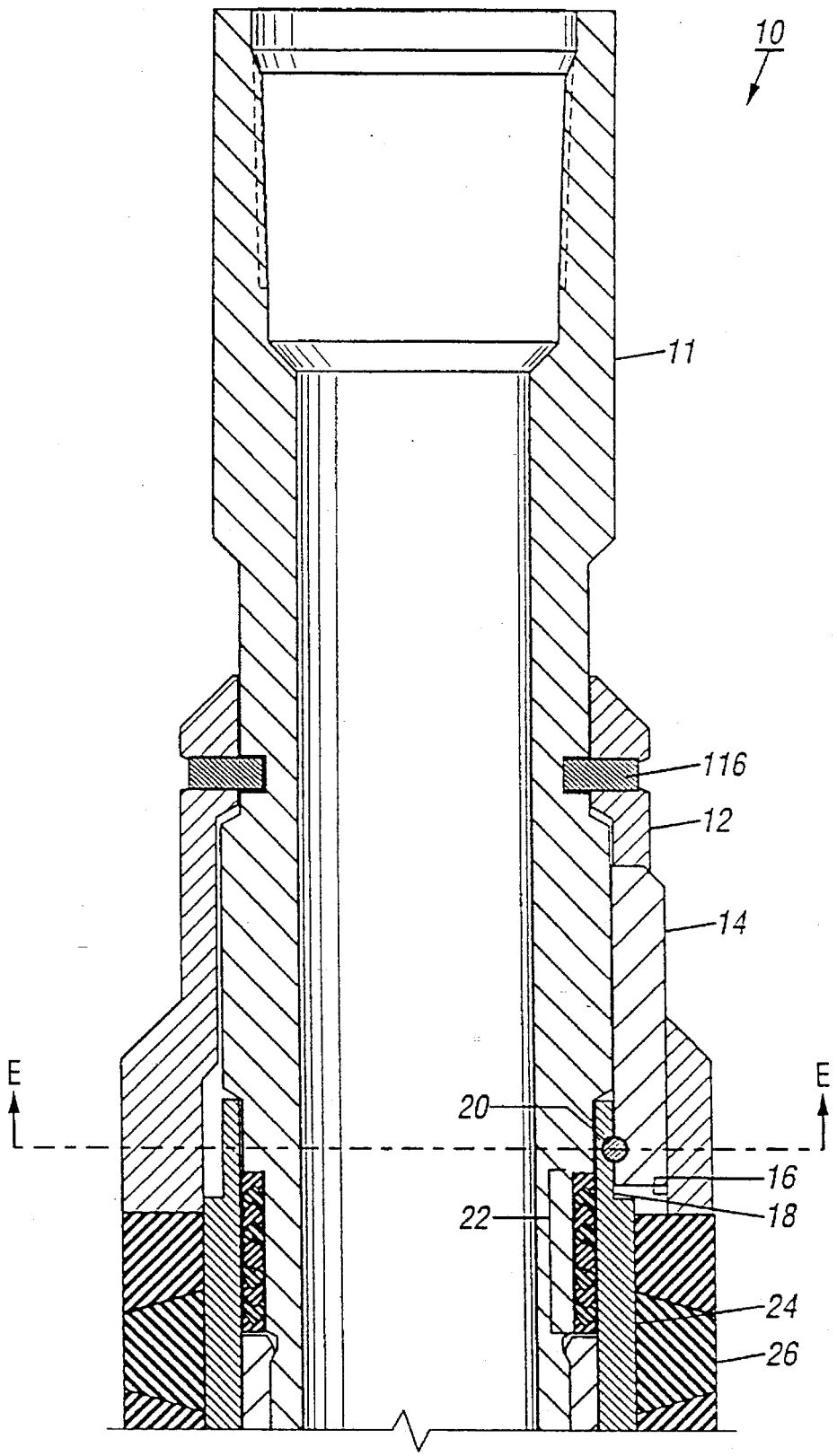
FIGS. 1A–D taken together are a longitudinal view shown in section of a well tool, such as a well packer, having one preferred embodiment of an anchoring mechanism of the present invention.
Figure 1B:
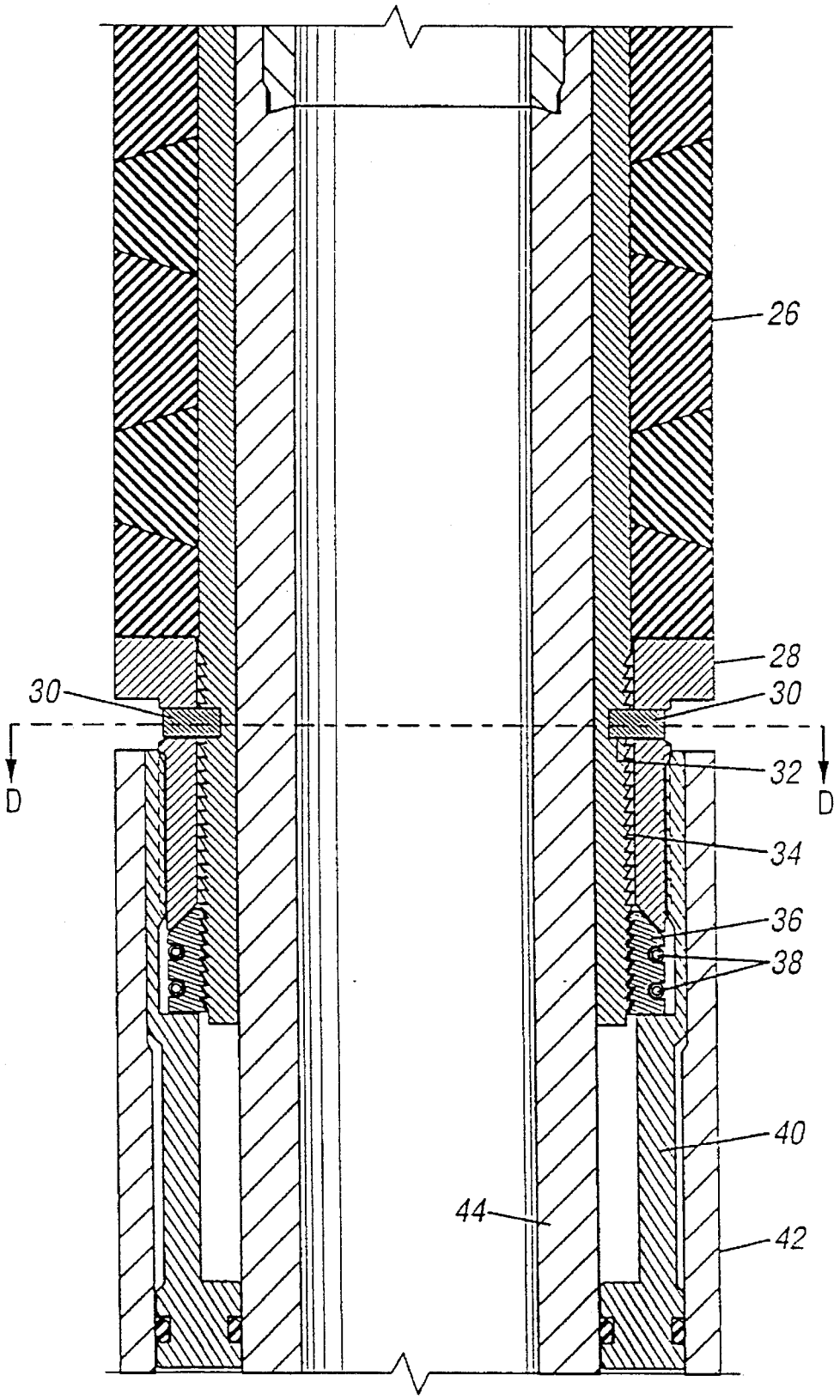
Figure 1C:
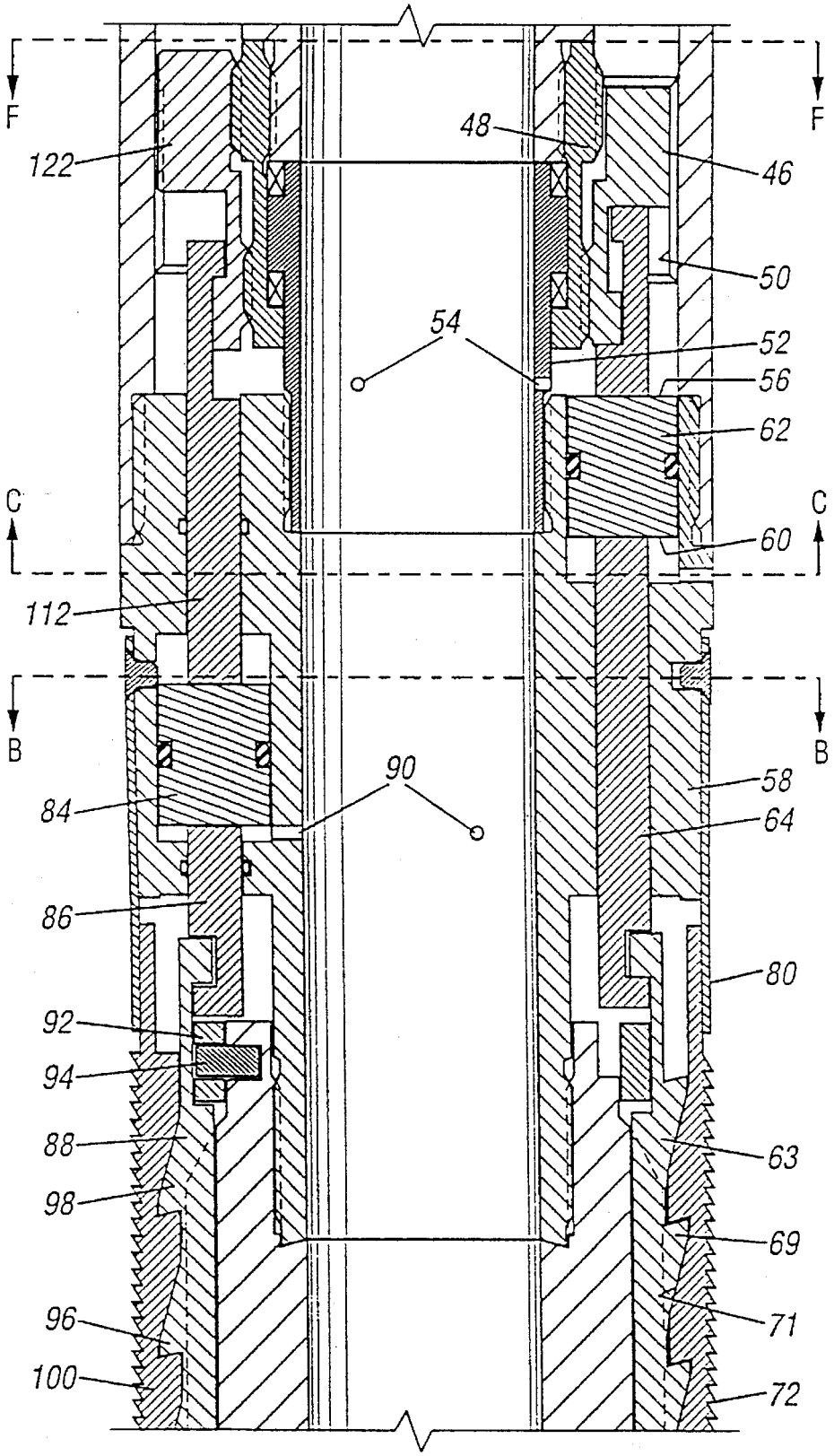
Figure 1D:
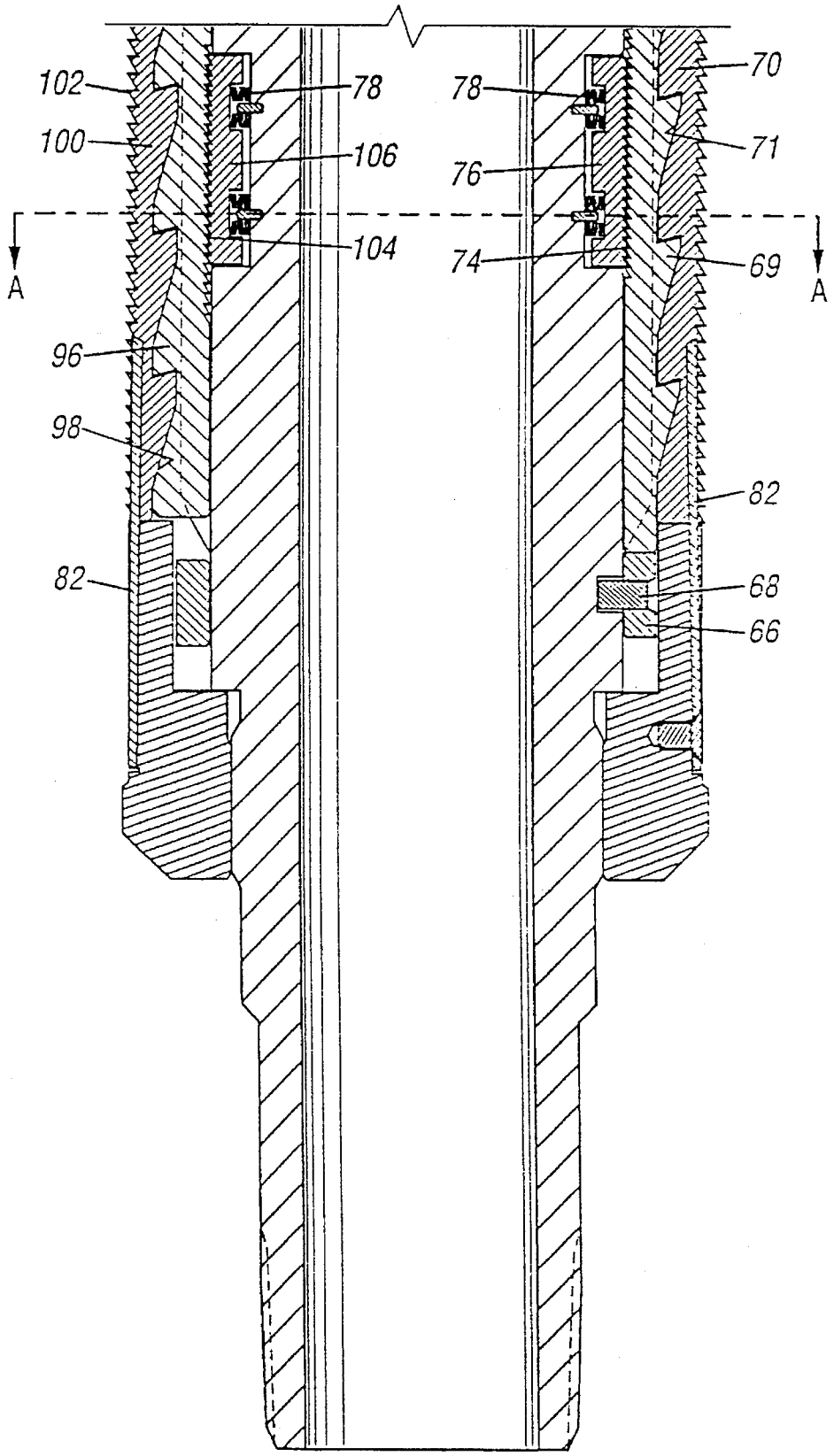

While the present invention is a mechanism for anchoring a well tool to a casing, and will be described in conjunction with its use in a packer for purposes of illustration only. It is to be understood that the described mechanism can be used in other well tools where anchoring and/or supporting such well tools from the inside of a well conduit is a desired end, such as with a liner hanger. Specifically, the packer of the present invention includes a plurality of first slip members, adapted to restrain well tool movement in a first direction, and a plurality of second slip members, adapted to restrain well tool movement in a second direction. The first slip members and the second slip members are carried on the well tool at the approximate same longitudinal position, and the first slip members are alternately circumferentially positioned with the second slip members. Each slip member is expanded by relative axial movement of an individual and independent segmented annular piston operatively connected to helical cones, the outside surfaces of which coact with the inside surface of each slip.

For the purposes of this discussion, the terms "upper" and "lower", "up hole" and "downhole", and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Referring now to FIGS. 1A–D, a well tool, such as a packer 10, includes an upper tubing connector 11 for sealable connective engagement at an upper end thereof with a well tubing (not shown). The well tubing can be used to lower the packer 10 into the well and to retrieve same, as well as provide a conduit of fluid therethrough to operate internal components of the packer 10 (as will be described in detail below) and to convey fluids from the well to the earth's surface, all as is well known to those skilled in the art.

An upper gauge ring 12 is threadably attached to the upper tubing connector 11, and a torque transmitting key 14 is held in a gauge ring slot 16 in an element mandrel slot 18, and is retained by a tangential pin 20. A packing stack 22, comprising one or more elastomeric annular elements, creates and maintains a fluid seal between the upper tubing connector 11 and an element mandrel 24. A packer element array 26, comprising one or more elastomeric annular elements, is held between the upper gauge ring 10 and a lower gauge ring 28. The element array 26, when compressed makes contact with the well casing (not shown) and thereby forms a fluid seal between the packer 10 and the well casing. The lower gage ring 28 is held in fixed longitudinal position by a set of radially positioned element setting shear pins 30, which are engaged in threaded holes 32 in the element mandrel 24.

The element mandrel 24 has formed in its exterior lower end thereof a ratchet retention thread 34 which engages a set of element setting ratchets 36, which are held in position by at least one garter spring 38 (two shown). An element compression piston 40 operates between a cylinder 42 and an inner mandrel 44, and operates against the lower end of the ratchets 36. A first piston stop 46, threads into an inside diameter thread 50 in the cylinder 42. A threaded adapter 48 connects to the first piston stop 46. An upper ported mandrel 52 permits fluid present in the tubing (not shown) to pass through a first set of communication ports 54 to the element compression piston 40, and a first face 56 of an upper segmented annular piston 60. A segmented annular cylinder body 58 permits fluid in the well annulus to pass to a second face 60 of the upper segmented annular piston 62.

The upper segmented annular piston 62 is moved downward by differential pressure between the inside of the tubing and the well annulus and makes contact with a first cone 63, through an integral lower cylindrical extension 64. Downward motion of the upper segmented annular piston 60 and cone 62 is restrained by contact with a first shear ring 66, and a set of radially positioned slip setting shear pins 68. An external surface of the cone 62 is formed with a first series of wedges 69, whose preferred embodiment is an external helical thread. The profile of these wedges 69 coacts with a matching internal surface 71 of a first slip 70. The outside surface of the first slip 70 is a series of gripping teeth 72, whereby engagement of such gripping teeth 72 with the well casing (not shown) prevents axial movement of the well tool.

The inside surface of the first cone 63 is formed with a threaded ratchet sleeve 74, and coacts with a first set of slip retaining ratchets 76. The ratchets 76 are held in compressive engagement by a set of bellville springs 78, which exert a radially outward force against the threaded ratchet sleeve 74 and ultimately the slips 70. This radially outward force is counteracted by an first leaf spring 80 and a second leaf spring 82, which maintain a radially inward force against the first cone 62. Axially downward movement of the first cone 63 is allowed by the retaining ratchet 76, but any such reverse (axially upward) movement is prevented. Setting the first slip 70 prevents movement of the packer 10 in the axially downward direction.

A lower segmented annular piston 84 is moved upward by differential pressure between the inside of the tubing and the well annulus acting through a lower hydraulic port 90, and makes contact with a second cone 88, through an integral lower cylindrical extension 86. Upward motion of the lower segmented annular piston 84 pulls a second cone 88 upward, but is restrained by contact with a second shear ring 92, and a set of circumferentially positioned slip setting shear pins 68. An external surface of the second cone 88 is formed with a second series of wedges 96 (opposite in direction from the above described wedges 69) whose preferred embodiment is an external helical thread. The profile of these wedges 96 coacts with a matching internal surface 98 of a second slip 100. The outside surface of the second slip 100 is a series of gripping teeth 102, whereby engagement of such gripping teeth 102 with the well casing (not shown) prevents axial movement of the well tool in a second direction.

The inside surface of the second cone 88 is formed with a threaded ratchet sleeve 104, and coacts with a set second set of slip retaining ratchets 106. The ratchets 106 are held in compressive engagement by a set of bellville springs 78, which exert a radially outward force against the threaded ratchet sleeve 104 and ultimately the slips 100. This radially outward force is counteracted by a first leaf spring 80 and a second leaf spring 82, which maintain a radially inward force against the second cone 100. Axially upward movement of the second cone 88 is allowed by the second set of slip retaining ratchets 106, but any such reverse (axially downward) movement is prevented. Setting the second slip 100 prevents movement of the packer 10 in the axially upward direction.

As described briefly before, the anchoring mechanism of the present invention permits a more compact arrangement than previous slips, as well as permits a force to be exerted on each of the slips individually that is greater than the force exerted by a single piston, as in the past. The slip members 70 and their respective pistons 62 are preferably but not required to be carried on the packer 10 at the approximate same longitudinal position with as the slip members 100 and their respective pistons 84. The slip members 70 are preferably but not required to be alternately circumferentially positioned with the slip members 100. Additionally, each piston 62 or 84 preferably operates only one slip member 70 or 100; however, in certain designs one or more of the pistons 62 or 84 can be operatively connected to one or more slips 70 or 100, but this is not preferred.

Figure 2:
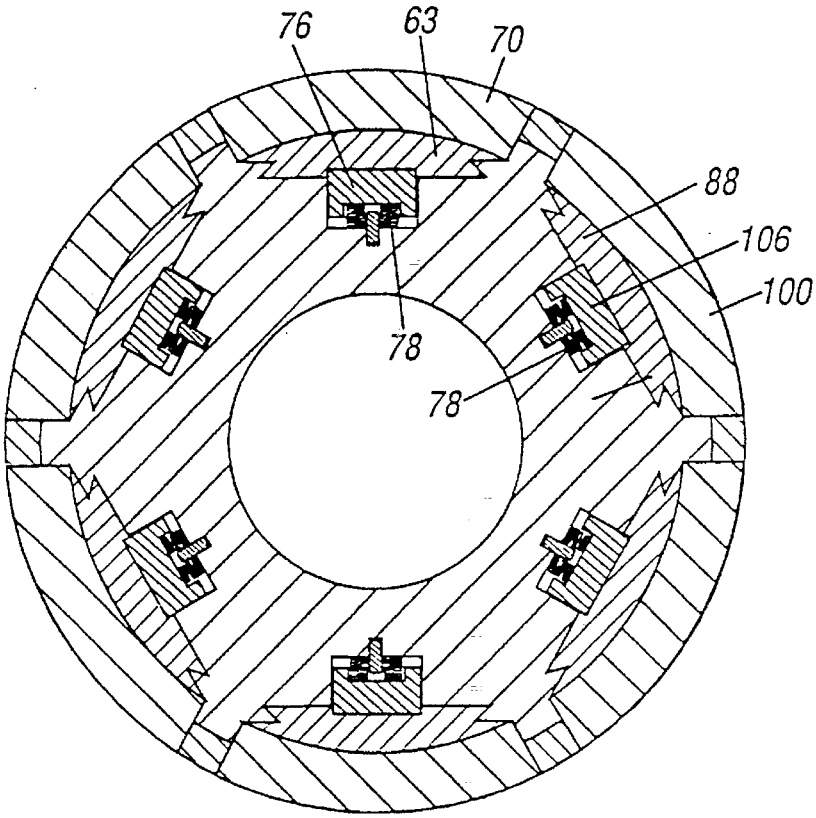
FIG. 2 is a cross-section of the packer of FIG. 1D shown at "A—A", which illustrates an array of slip members shown in circumferentially oriented about the longitudinal centerline of the packer.

The novel arrangement of the pistons 62 and 84 and the slip members 70 and 100 can best be shown in the cross-section view of FIGS. 2–8. These Figures show just one preferred embodiment; however, other circumferential and linear arrangements of the components can be made. FIG. 2 illustrates the radial interconnection of three first slips 70, interspaced between three second slips 100. Connected to the first slips 70 are three first cones 66, which are adjacent to three first retaining ratchets 76. Connected to the second slips 100 are three second cones 88, which are adjacent to three second retaining ratchets 106. Both first retaining ratchets 76 and second slip retaining ratchets 106 are held in compressive engagement with its respective slip by belleville springs 78.

Figure 3:
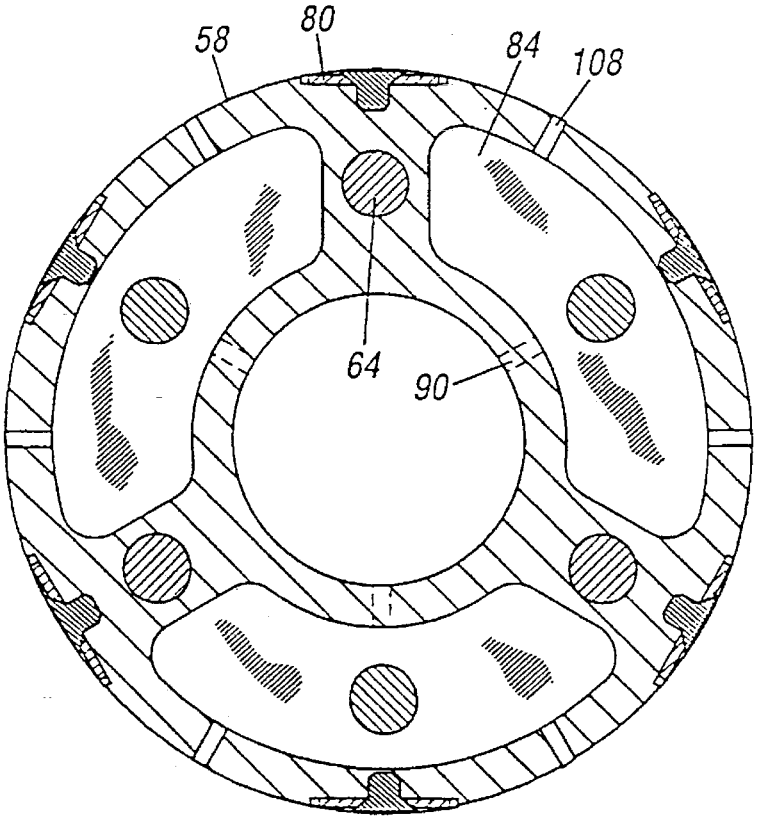
FIG. 3 is a cross section of the packer of FIG. 1C shown at "B—B", which illustrates a set of three segmented annular pistons for use in the present invention.
Figure 4:
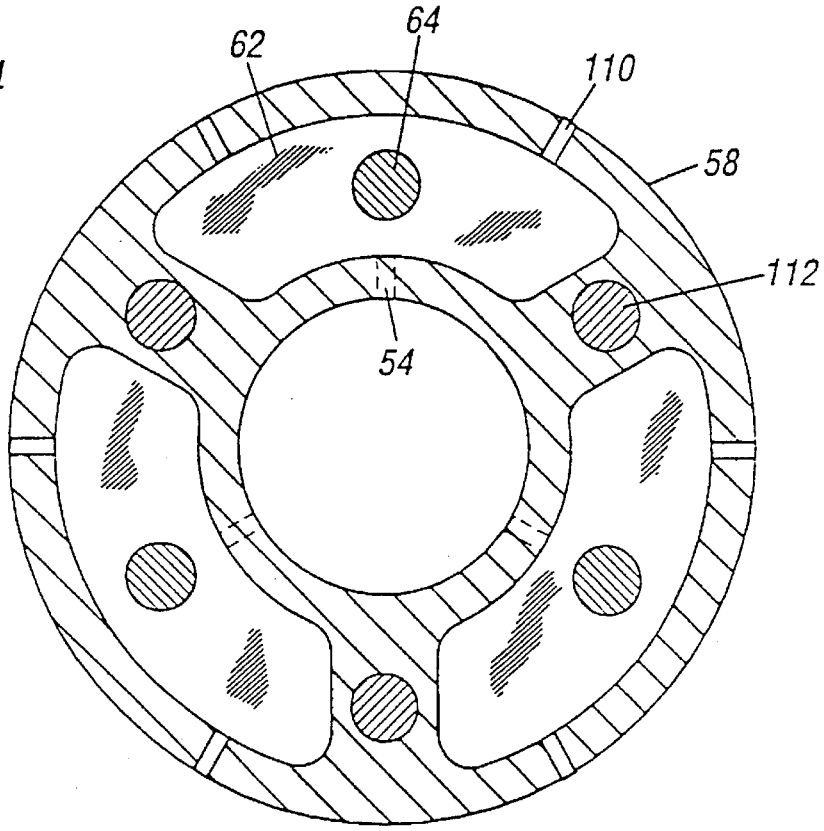
FIG. 4 is a cross section of the packer of FIG. 1C shown at "C—C", which illustrates a second set of three segmented annular pistons for use in the present invention.

FIG. 3 illustrates the radial interconnection and orientation of three lower segmented annular pistons 84 which are held inside the segmented annular cylinder body 58. Three integral lower cylindrical extensions 62 of the upper segmented annular piston 60 (not shown in FIG. 3) are interspaced in this view. The orientation of the three lower hydraulic ports 90 and six lower annular pressure ports 108 are illustrated. Six leaf springs 80 are shown connected to the segmented annular body 58. FIG. 4 illustrates the circumferential interconnection and orientation of three upper segmented annular pistons 62, which are held inside the segmented annular cylinder body 58. Three integral upper cylindrical extensions 112 of the lower segmented annular piston 84 are interspaced in view. The orientation of the three upper hydraulic ports 54 and six upper annular ports 110 are illustrated.

Figure 5:
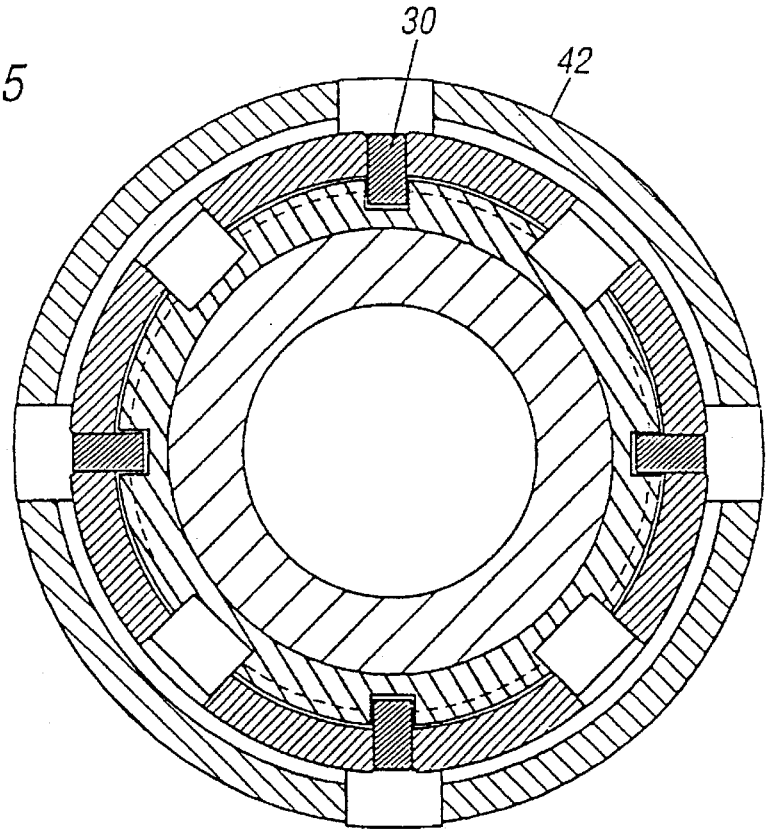
FIG. 5 is a cross section of the packer of FIG. 1B shown at "D—D", which illustrates a set of shear pins shown in radial orientation about a retaining ratchet sleeve.
Figure 6:
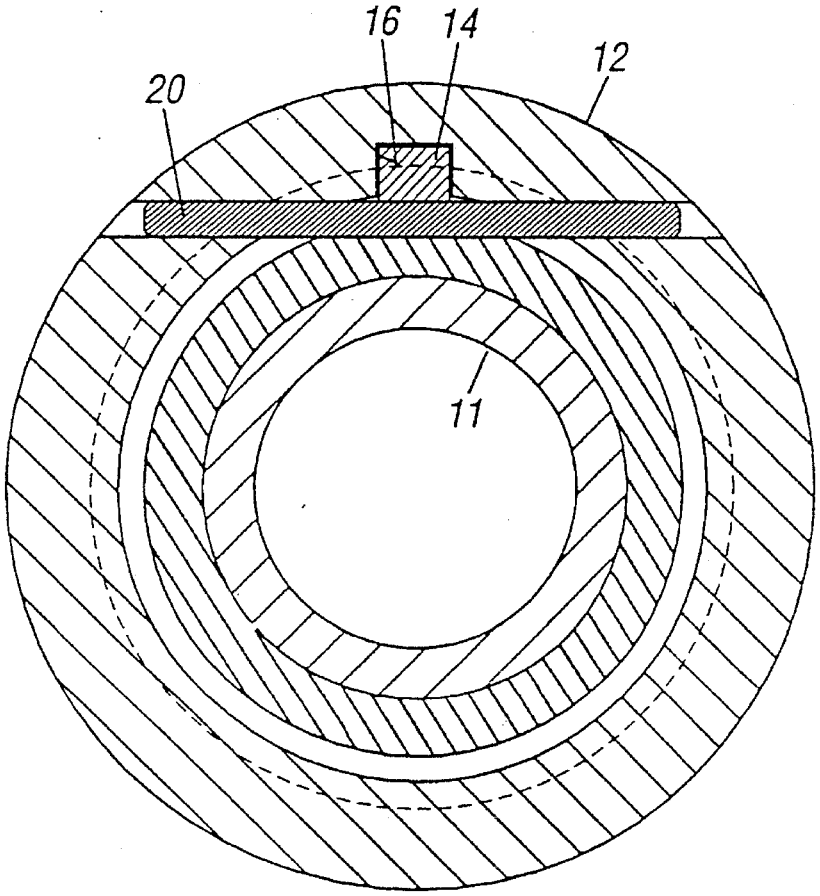
FIG. 6 is a cross section of the packer of FIG. 1B Shown at "E—E", which illustrates a key and tangential pin in locking engagement.

FIG. 5 illustrates the circumferential interconnection and orientation of the element setting shear pins 30, and the element setting ratchets 36. The element setting shear pins 30 serve to hold the assembly in the running position until it becomes operationally desirable to set the packer. At a predetermined setting pressure, the element setting shear pins 30 shear allowing pressure acting on the heretofore described mechanism to move the element setting ratchets 36 longitudinally upwards, effectively retaining the energy used to set the packer 10 in the element array 26. FIG. 6 illustrates the radial interconnection and orientation of the upper tubing connector 11, the upper gauge ring 12, the torque transmitting key 14, the gauge ring slot 16 and the tangential pin 20. When it becomes operationally desirable to release energy stored in the element as a result of setting, torque applied to the upper tubing connector 11 is transmitted to the upper gauge ring 12 by the torque transmitting key 14.

FIG. 6 illustrates the interconnection of the a torque transmitting key 14, and it's corresponding gauge ring slot 16, and its radial orientation with an upper gauge ring 12, and a tangential pin 20.

Figure 7:
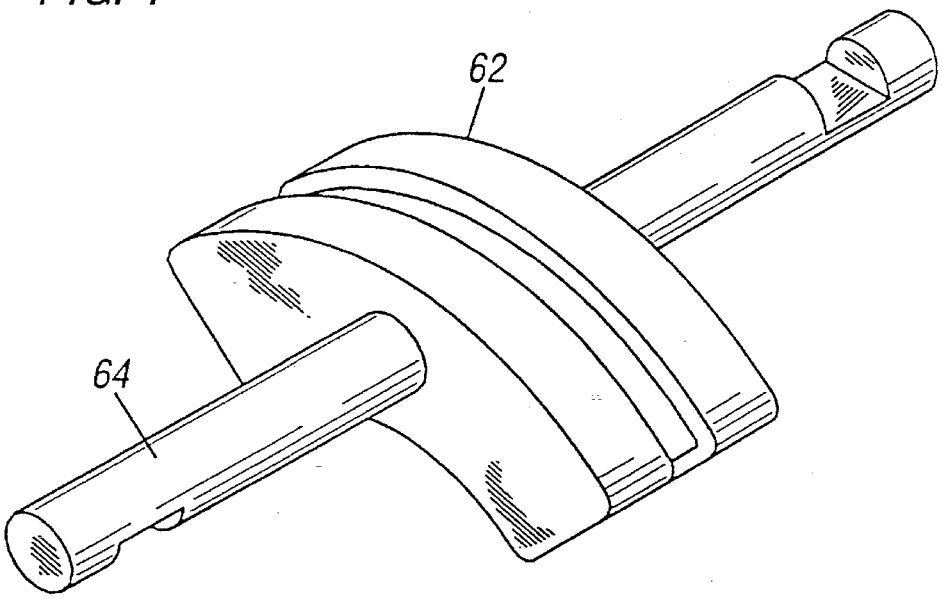
FIG. 7 is an isometric view of one preferred embodiment of a segmented annular piston with radiused corners and cylindrical extensions for use in the present invention.
Figure 8A:
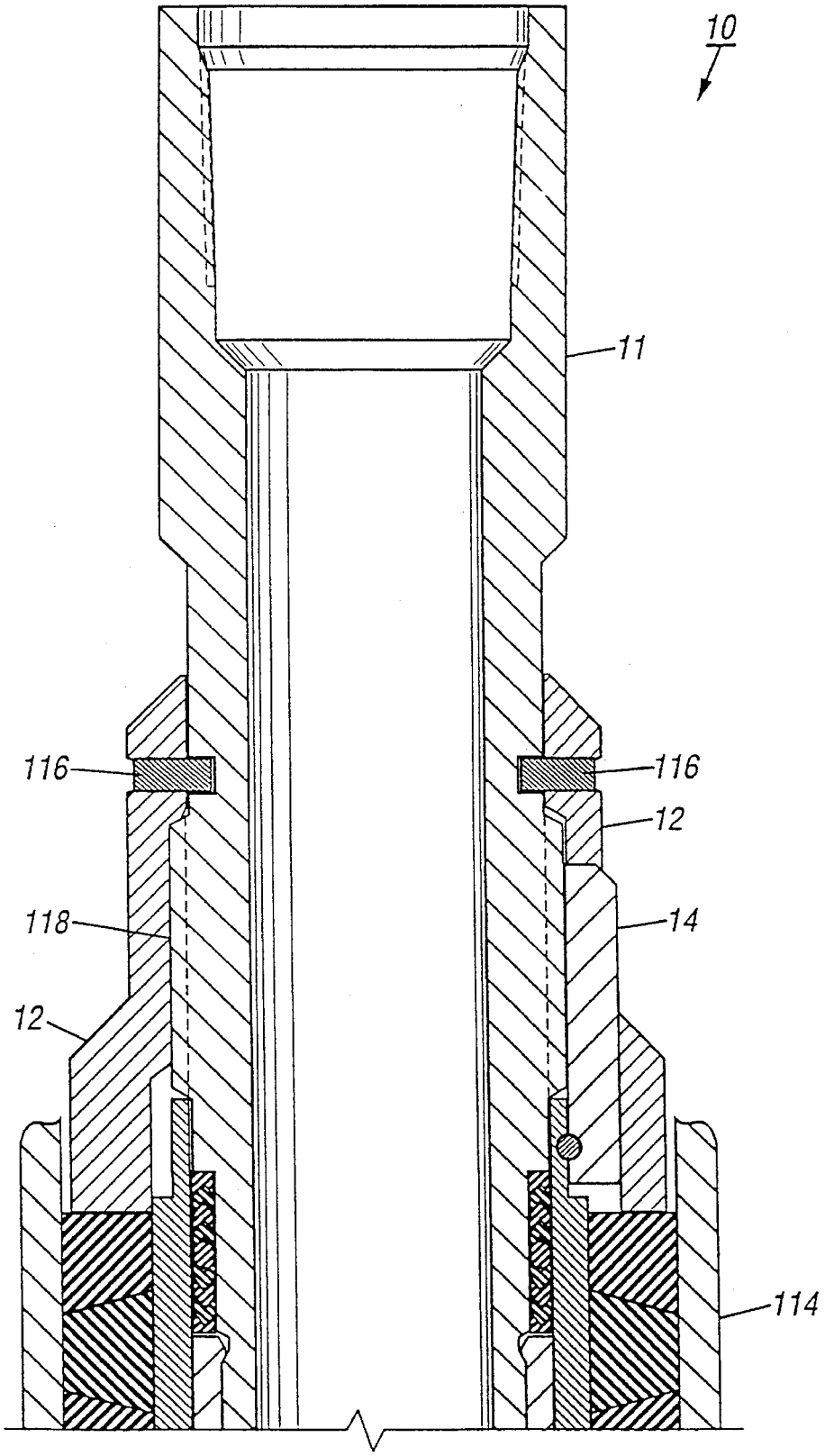
FIGS. 8A–D taken together are a longitudinal view shown in elevation of the packer of FIG. 1 shown in the "set" or slips extended position.
Figure 8B:
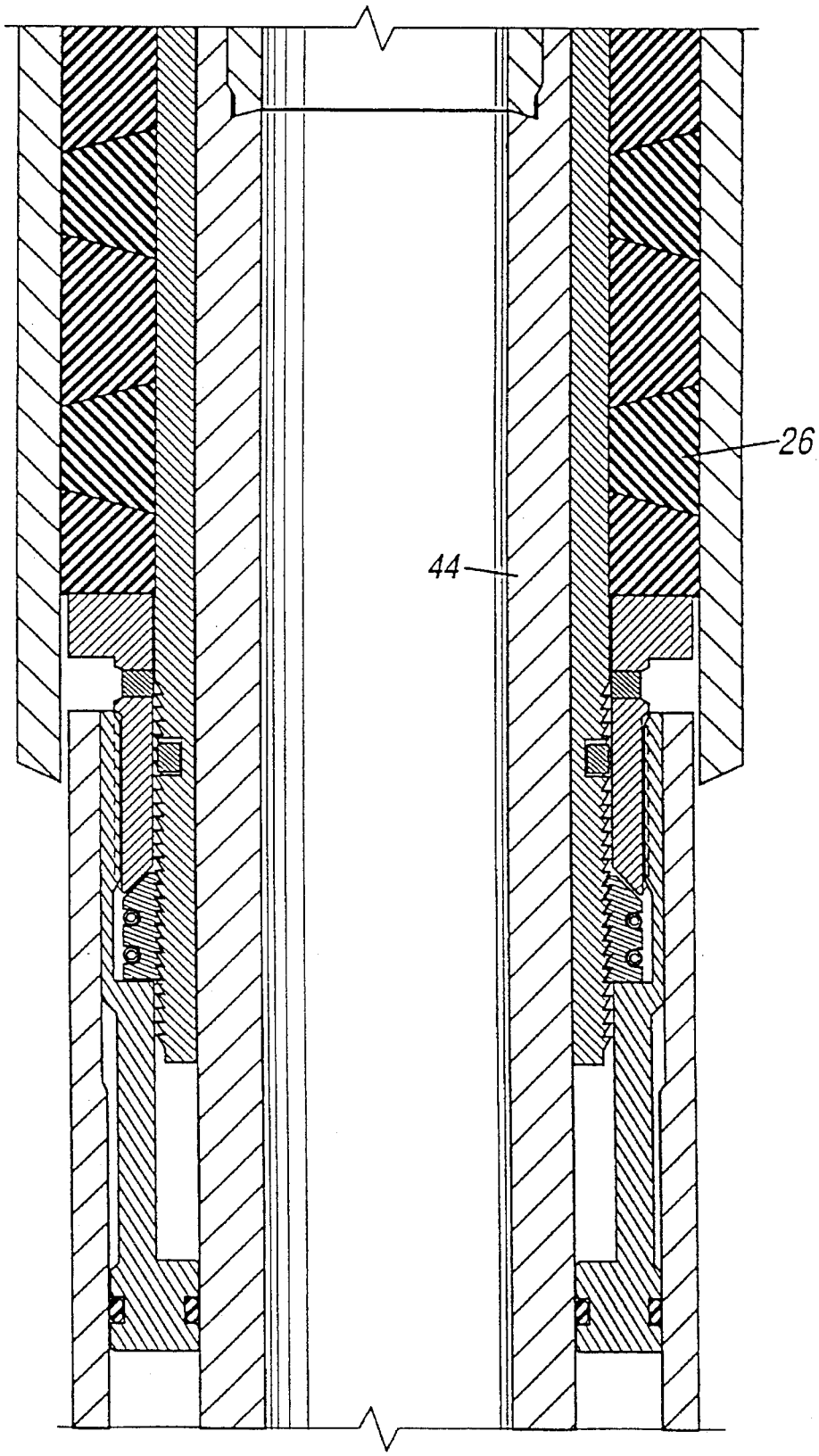
Figure 8C:
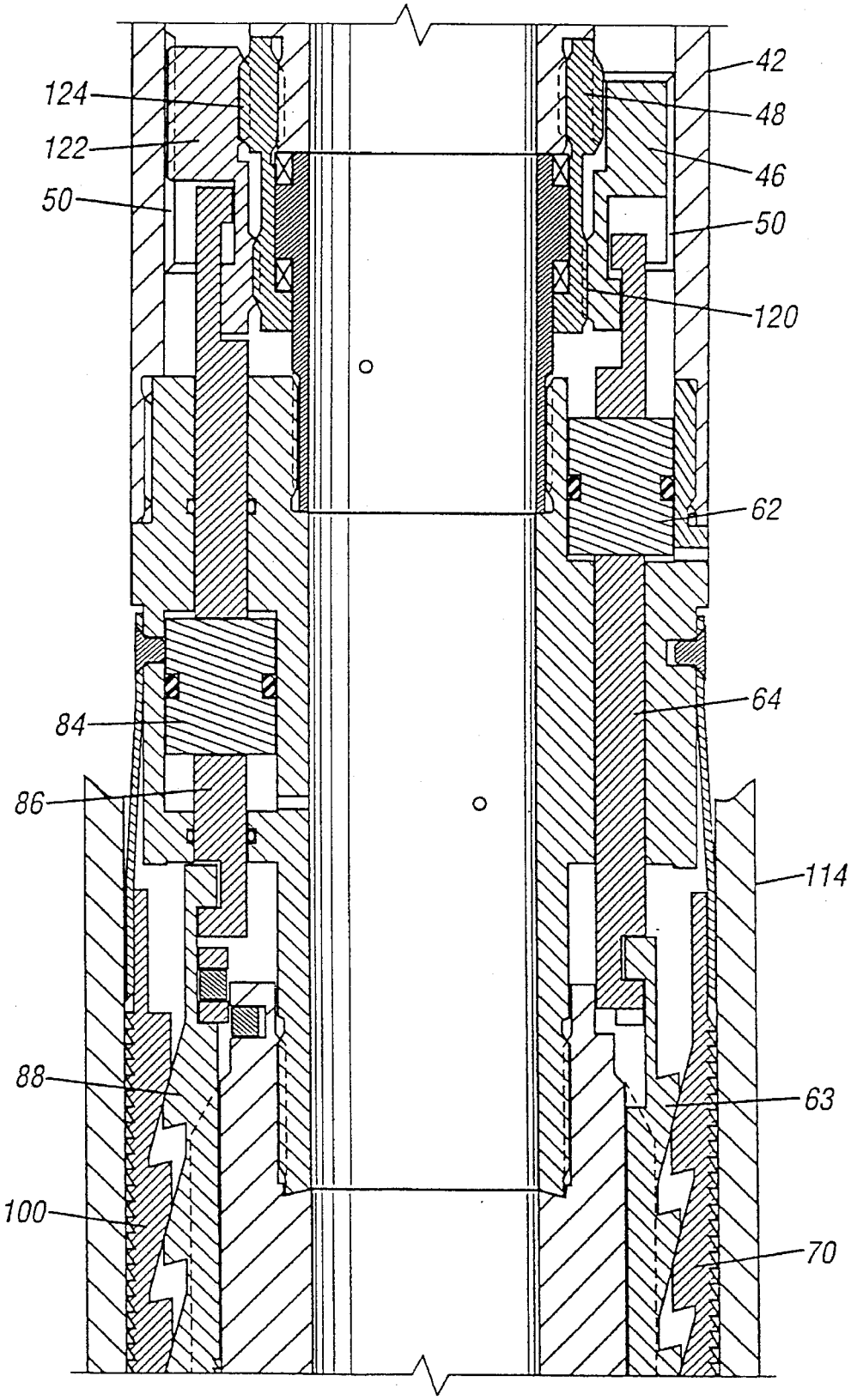
Figure 8D:
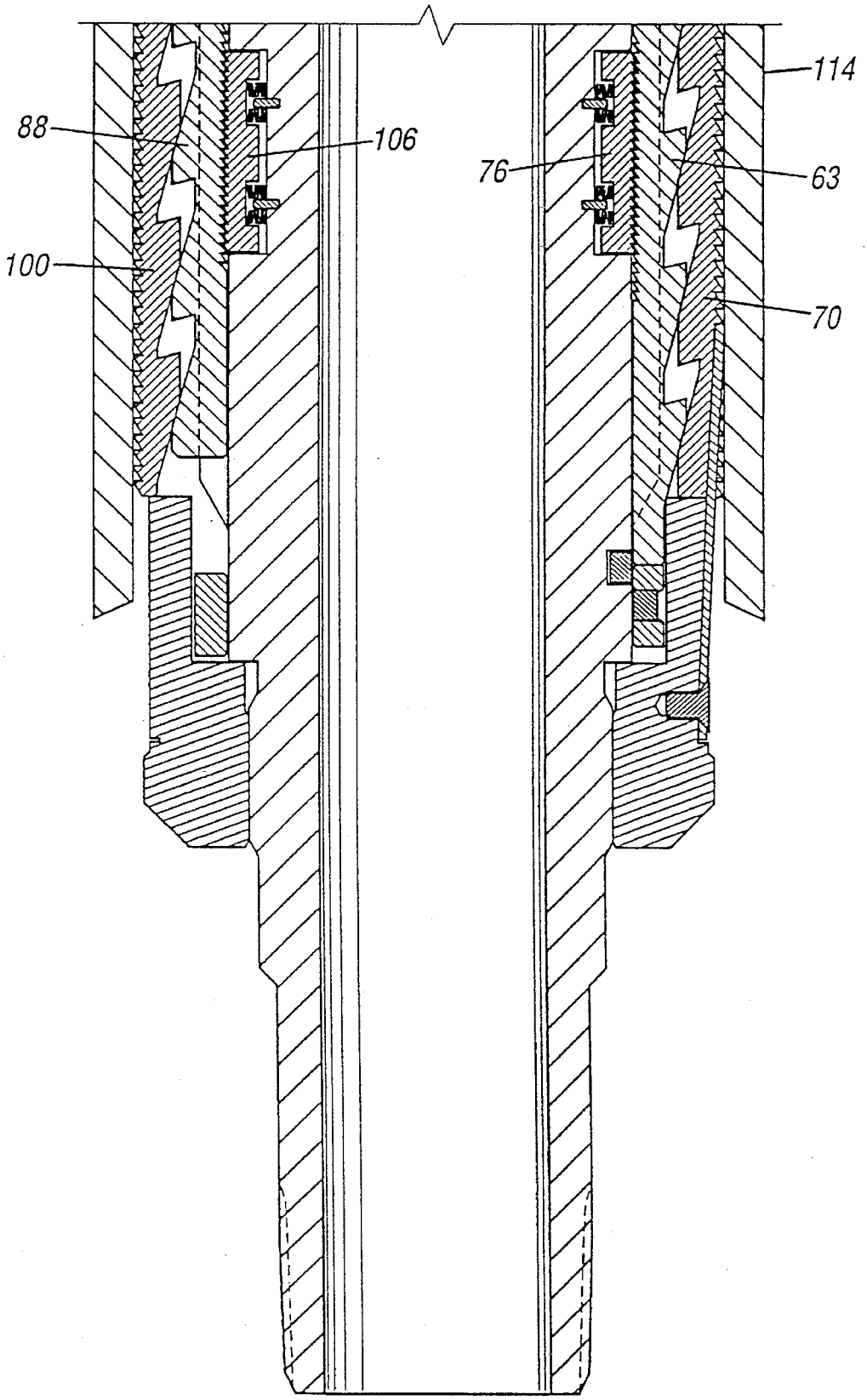

FIG. 7 illustrates one preferred embodiment of the segmented annular pistons 62 and 84, with cylindrical extensions 64 or 112, and preferred radiused corners. The design shown is believed to provide the maximum piston surface area for the given area within the well tool; however, those skilled in the art will understand that other shapes can be used, such as square, oval, circular, triangular, etc.

When it is operationally desirable to set the well packer of the present invention, the well packer is sealably connected to the well tubing and "run-in" or positioned in the desired location in the well. A device well known to those skilled in the art called a blanking plug (or other such device which serves to plug the tubing) is lowered to a position below the well packer, and sealably connected to another well known device called a tubing nipple. Hydraulic fluid can now be added to the tubing from the surface, and is totally contained in the well tubing. As additional fluid is pumped into the tubing, the pressure in the tubing increases and flows into the first set of communication ports 54, and the lower hydraulic ports 90. The pressure flowing into the first set of communication ports 54 acts to move the upper segmented annular piston 62 longitudinally downward against the first cone 63, which acts to move the first shear ring 66 downward. Initially, the pressure to set the well packer is resisted by the slip setting shear pins 68 in the first shear ring 66, but at a predetermined pressure, the slip setting shear pins 68 shear, allowing the first cone 63 to move downward. When this occurs, the first slip 70 moves axially outward and into engagement with the inside diameter of the well casing. Movement of the first cone 63 is restricted to downward only by action of the first slip retaining ratchets 76. The fluid flowing into the first set of communication ports 54 also acts against the element compression piston 40, biasing it axially upward, the movement of such is retained by the element setting shear pins 30. At a precise and predetermined pressure, the element setting shear pins 30, shear allowing the element compression piston 40 to compress the element array 26 into compressive and sealable engagement with the inside diameter of the well casing 114. Movement of the element compression piston 40 is restricted to upward only action by the element setting ratchet 36.

Likewise, pressurized fluid flows into the lower hydraulic port 90 and acts on the lower segmented annular piston 84, biasing is axially upward, which acts to move the second shear ring 92 upward. Initially, the pressure to set the well packer is resisted by the slip setting shear pins 68 in the second shear ring 92, but at a predetermined pressure, the slip setting shear pins 68 shear allowing the second cone 88 to move upward. When this occurs, the second slip 100 moves axially outward and into engagement with the inside diameter of the well casing. Movement of the second cone 88 is restricted to upward only by action of the second set of slip retaining ratchets 106. When the above has occurred, in this sequence or in any other desired sequence, the well packer of the present invention has been set.

Referring now to FIGS. 8A–D, the packer 10 is shown set in a well casing 114. The element array 26 is shown compressed and in sealable engagement with the inside surface of the well casing 114. The first slip 70, is shown in connective engagement with the inside surface of the well casing 114 preventing tool movement in a first direction, and the second slip 100 is also shown in connective engagement with the inside surface of the well casing 114 preventing movement in a second direction. When it becomes operationally desirable to release the packer 10, right hand torque is applied to the well tubing (not shown) to which the packer 10 is connected, which shears a set of releasing shear pins 116, allowing the upper tubing connector 11 to rotationally move relative to the element mandrel 24. As a result of this rotation, a first right hand thread 118 moves the upper gauge ring 12 longitudinally upward, releasing setting energy stored in the element array 26, which relaxes the sealable compressive engagement with the inside diametrical wall of the well casing 114. Simultaneously, the heretofore described rotation of the upper tubing connector 11 also allows the inner mandrel 44 to synchronously rotate along with the threaded adapter 48. A second right hand thread 120 is threadably engaged with the first piston stop 46, and moves longitudinally upward as a result of the described rotation. The first piston stop 46 is prevented from rotating with the second right hand thread 120 by at least one milled groove 50, cut into the cylinder 42, but still will allow axial motion. This axial movement allows the connected parts (i.e., the upper segmented annular piston 62, the integral lower cylindrical extension 64, and the first cone 63), ) to move enough to shear the first set of slip retaining ratchets 76, and to continue to move longitudinally upward. The first slip 70 is no longer supported by the first cone 63, and therefore also moves radially inward, releasing the first slip 70 from connective engagement with the inside diameter of the well casing 114.

The described rotation applied to the upper tubing connector 11 allows the described inner mandrel 44 to synchronously rotate along with the threaded adapter 48. A left hand releasing thread 124 engaged with the second piston stop 122 moves longitudinally downward as a result of the described rotation. The second piston stop 122 is likewise prevented from rotating with the left hand thread 120 by at least one milled groove 50, cut into the cylinder 42, but still will allow axial motion. This axial movement allows the connected parts (i.e. the lower segmented annular piston 84, the integral lower cylindrical extension 86, and the second cone 88) to move enough to shear the second set of slip retaining ratchets 106, and to continue to move longitudinally downward. The second slip 100 is no longer supported by the second cone 88, and therefore moves radially inward, releasing the second slip 100 from connective engagement with the inside diameter of the well casing 114.

Figure 9:
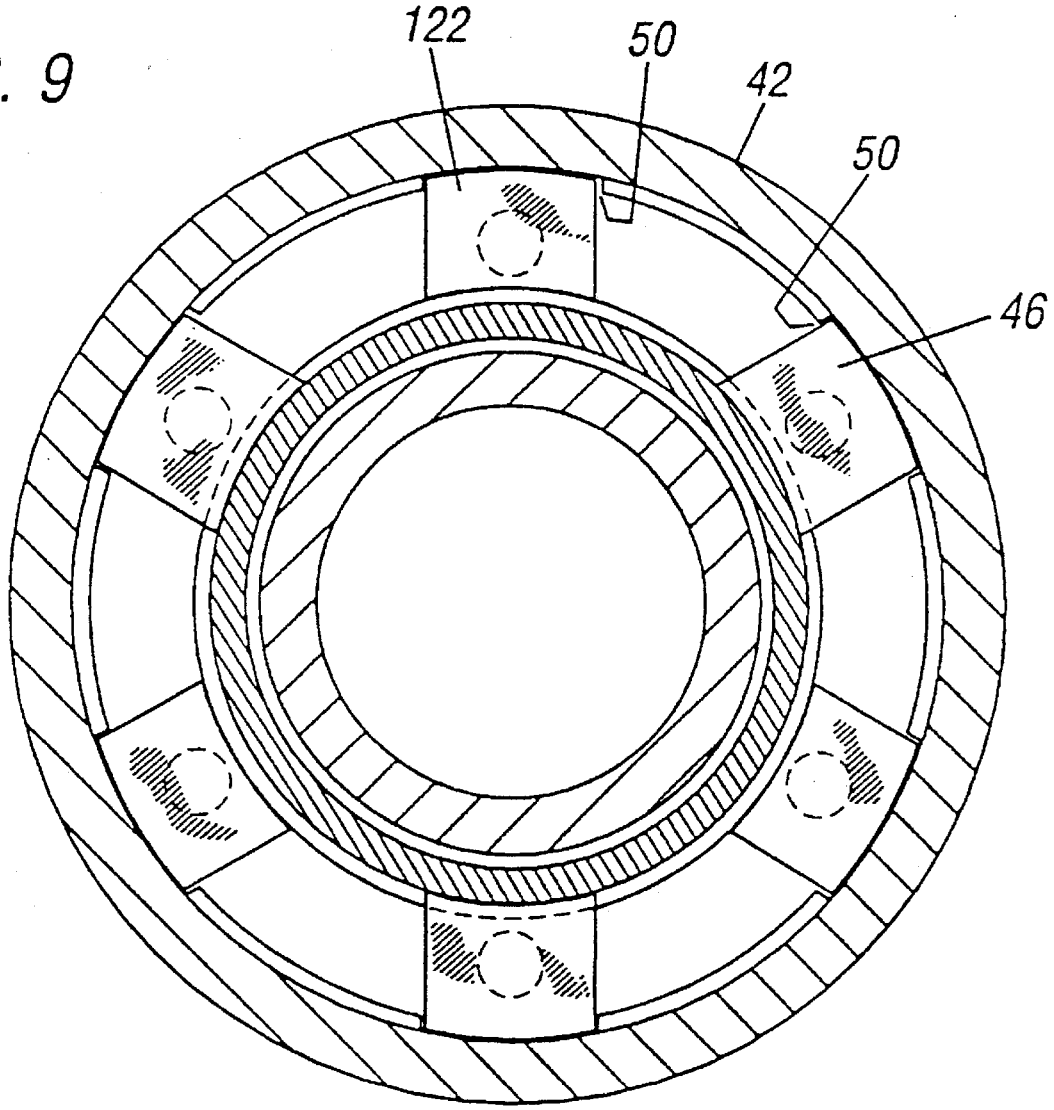
FIG. 9 is a cross section of the packer of FIG. 1C shown at "F—F", which illustrates piston stops and threaded connections for use when the slip members are to be released.

FIG. 9 illustrates a cross section of FIG. 1, shown at "F—F", and illustrates the radial interconnection of a first piston stop 46, and a second piston stop, and their engagement with a plurality of milled grooves 50, in a cylinder 42, the engagement of which allows slidable axial movement, but prevents radial movement.

Whereas the present invention has been described in particular relation to the drawings attached hereto, it should be understood that other and further modifications, apart from those shown or suggested herein, may be made within the scope and spirit of the present invention.

What is claimed is:

1. A mechanism for anchoring a well tool to a casing, comprising: a plurality of first slip members, adapted to restrain well tool movement in a first direction, and a plurality of second slip members, adapted to restrain well tool movement in a second direction; the first slip members and the second slip members being carried on the well tool at the approximate same longitudinal position, and the first slip members being alternately circumferentially positioned with the second slip members; and at least one of the first slip members is expanded by relative movement in a first direction of a wedge member operatively connected to a first piston, and at least one of the second slip members is expanded by relative movement in a second direction of a wedge member operatively connected to a second piston.

2. The mechanism of claim 1 wherein certain of the first slip members are held in a retracted position on the well tool by a frangible restrainment mechanism adapted to release the first slip members simultaneously.

3. The mechanism of claim 2 wherein at least one of the first slip members is expanded by relative movement of a wedge member having grooves thereon that interact with ribs on an opposed side of the first slip member.

4. The mechanism of claim 3 wherein the grooves on the wedge member are a longitudinal segment of helix.

5. The mechanism of claim 3 and including means for transferring a force, applied in a direction opposite to the direction of movement to expand a first slip member, from the first slip member to the well tool.

6. The mechanism of claim 5 wherein the means for transferring forces comprises a ratchet segment having teeth on an exterior surface thereof cooperable with teeth on an interior surface of a corresponding wedge member, the ratchet segment carried between the wedge member and the well tool.

7. The mechanism of claim 2 wherein the well tool is a wellbore packer.

8. The mechanism of claim 1 further comprising a plurality of first pistons and a plurality of second pistons with the first pistons alternately circumferentially positioned with the second pistons.

9. The mechanism of claim 1 wherein each piston comprises a segmented annular piston with radiused corners with at least one cylindrical extension, extending out therefrom for connection to a wedge member.

10. The mechanism of claim 1 wherein each piston includes an annular segment piston head.

11. A mechanism for anchoring a well tool to a casing, comprising: a plurality of slip members carried on a well tool; a plurality of pistons each operatively connected to one of the slip members so that upon introduction of hydraulic fluid thereto each of the slip members is individually moved into engagement with an interior surface of the casing; and means to individually retract the slip members whereby axial rotational movement of a housing carried in the well tool causes each of the slip members pistons to retract.

12. The mechanism of claim 11 and including an array of first slip members and an array of second slip members with the first slip members and the second slip members carried at the approximate same longitudinal position on the well tool.

13. The mechanism of claim 12 wherein the first slip members are alternately radially spaced with the second slip members.

14. The mechanism of claim 12 wherein each of the pistons operatively connected to the first slip members are alternately circumferentially spaced with each of the pistons operatively connected to the second slip members.

* * * * *